US005878665A

United States Patent [19]

Muller

[11] Patent Number: 5,878,665

[45] Date of Patent: Mar. 9, 1999

[54] CONTROL SYSTEM FOR THE DRIVE OF A PRINTING MACHINE

[75] Inventor: Joachim Muller, Wolfratshauser Strasse, Germany

[73] Assignee: MAN Roland Druckmaschinen AG, Germany

[21] Appl. No.: 953,299

[22] Filed: Oct. 17, 1997

[30] Foreign Application Priority Data

Oct. 19, 1996 [DE] Germany ..... 196 43 252.9

[51] Int. Cl.[6] ..... B41F 5/02; B41F 13/004

[52] U.S. Cl. ..... 101/216; 101/183

[58] Field of Search ..... 101/216, 181, 101/183, 365

[56] References Cited

U.S. PATENT DOCUMENTS

| | | | |
|---|---|---|---|
| 4,428,288 | 1/1984 | Harper et al. | 101/248 |
| 4,791,866 | 12/1988 | Kanno et al. | 101/118 |
| 4,951,567 | 8/1990 | Rodi et al. | 101/216 |
| 5,588,362 | 12/1996 | Sugiyama et al. | 101/185 |

FOREIGN PATENT DOCUMENTS

| | | |
|---|---|---|
| 0 160 167 | 11/1985 | European Pat. Off. . |
| 0 243 728 B1 | 4/1987 | European Pat. Off. . |
| 41 32 766 A1 | 4/1993 | Germany . |
| 41 37 482 A1 | 5/1993 | Germany . |
| 42 14 707 A1 | 11/1993 | Germany . |
| 44 07 642 C1 | 8/1995 | Germany . |
| 44 06 727 A1 | 9/1995 | Germany . |

*Primary Examiner*—John Hilten
*Assistant Examiner*—Daniel J. Colilla
*Attorney, Agent, or Firm*—Leydig, Voit & Mayer, Ltd.

[57] ABSTRACT

A control system for controlling the rotational speed of the printing cylinders of a printing machine in order to eliminate register offset or doubling phenomena on the printed matter. The control system uses one or more sensors to determine the operating condition of the printing unit. The relevant operating condition parameters include the frequency of the AC line from which the printing machine operates and the position of the printing cylinders at the time the change in rotational speed is to occur. Based on the operating condition of the printing unit, a controller selects an appropriate timing ramp for increasing or decreasing the rotational speed of the printing cylinders. The various timing ramps are stored on a memory and correspond to the different operating conditions of the printing unit. Once, the appropriate timing ramp has been selected, the controller controls the rotational speed of the drive motor that rotates the printing cylinders in a manner that is proportional to the rate of change and duration characteristics of the selected timing ramp.

11 Claims, 5 Drawing Sheets

CONTROL SYSTEM FOR THE DRIVE OF A PRINTING MACHINE

FIELD OF THE INVENTION

This invention relates to a control system for controlling the rotational speed of printing cylinders in the individual printing units of a printing machine, and more particularly, to a control system that controls the rotational speed of the printing cylinders in a manner that eliminates register offset or doubling phenomena on the printed matter.

BACKGROUND OF THE INVENTION

Sheet-fed offset printing machines generally have direct current speed-controlled drive motors to drive the printing cylinders of a printing machine at a desired rotational speed. Direct current motors make it possible to implement predefined rotational speed ramps for increasing or decreasing the rotational speed of the printing cylinders in the individual printing units of the printing machine. In other words, the rotational speed of the printing cylinders is changed according to a predefined timing function. Generally, the rotational speed of the printing cylinders is increased according to a speeding-up ramp that is as flat as possible, i.e., in a relatively large time interval. The large time interval avoids the situation in which after a first sheet has run into the machine and the individual printing cylinders have been switched to the printing-on position, the load moment caused by the additional starting torsion leads to a register offset or doubling phenomena on the printed product. Increasing the rotational speed of the printing cylinders as slowly as possible also has the advantage of allowing the inking and/or damping solution feeds to adapt the metering of the ink and/or damping solution to the increasing rotational speed of the printing cylinders.

Particularly in the case of sheet-fed offset printing machines having a speed-controlled direct current motor within the main drive, the rotational speed of the printing cylinders is often slowed down according to a very steep retardation ramp, i.e., in a relatively short time interval. Thus, it is only when the rotational speed of the printing cylinders is rapidly decreased that very high moments act on the printing cylinder or printing units and cause the drive trains to rotate relative to each other because of elasticity. It is precisely in this operating situation that register offsets or doubling phenomena occur. Moreover, when the rotational speed of the printing cylinders is reduced this rapidly, it is not possible to adapt the metering of the ink and/or damping solutions to the decreasing rotational speed of the printing cylinders given the design limitations of the inking and/or damping units.

DE 4 132 766 A1 discloses a speed regulating device for the drive motor of a printing machine that allows direct influencing of the torque acting on the drive train. However, it is not possible to flexibly adapt the speeding-up or slowing-down ramps as a function of the operating state of the machine (e.g., as a function of whether the printing cylinders are in a printing-on or printing-off position). Thus, although this speed regulating device limits the torque when the printing machine is slowed down, the slowing down ramps are not adapted in terms of their duration or slope to the adjusting motors effecting the ink and/or damping solution feed.

DE 4 137 482 A1 discloses a controller arranged between the converter control device and the machine control system for slowing-down the drive motor of a printing machine. The controller includes a rotational speed set-point timer and implements the slowing-down operation with reference to a speed/time coordinate system according to a three-phase characteristic curve. Using this controller, rapid slowing down is limited with phases of soft slowing down at the start and end of a slow down period. As a result, shock-like loading during the beginning and the end of the slowing-down operation is reduced. The disadvantages explained above, with respect to the possibility of tracking the ink and/or damping solution feed via appropriate adjustments while slowing down, are not overcome.

DE 3 214 707 A1 discloses a control system for a printing machine drive motor which has a starting-up torque control system to influence the starting-up torque when restarting the continuous printing speed for a drive motor of a printing machine. With this system, however, only those register offset or doubling phenomena which are caused by torsion when speeding up from a basic speed to a continuous printing speed are avoided or reduced.

EP 0 243 728 B1 discloses a safety system for a printing machine in which the main drive can be stopped under program control in accordance with the operating situations present. However, this stopping under memory and program control is not carried out in order to adapt the slowing down to the printing process.

SUMMARY OF THE INVENTION

It is the primary object of the present invention to provide a control system for the drive of a printing machine that best adapts the speeding-up or slowing-down operation of the printing machine to the contemporaneous operating condition of the machine in order to ensure that the quality of the printing process is not compromised.

It is another object of the invention to reduce and/or eliminate register offset or doubling phenomena when the rotational speed of the printing cylinders is increased or decreased while the printing cylinders are in the printing-on position.

Yet another object of the present invention is to adapt the rate and duration of change in the rotational speed of the printing cylinders to the line-frequency-dependent rotational speed of the inking unit and/or damping unit drive motors and to the ink and/or damping solution feed.

The invention uses a controller to increase or decrease the rotational speed of the printing cylinders in the individual printing units of the printing machine as a function of the operating condition of the printing unit. The operating condition of the printing unit is represented by four operational parameters: (1) whether the rotational speed of the printing cylinders is to be increased or decreased, (2) the net change in the rotational speed of the printing cylinders, i.e., the difference between the current rotational speed and the desired rotational speed, (3) whether the printing cylinders are in the printing-on or printing-off position when the change in rotational speed is to occur, and (4) the frequency of the line from which the printing machine is operating.

The controller includes a memory and is connected via a data transmission bus to an input device, an alternating-current to direct-current rectifier, a direct current drive motor, printing unit switch devices, and ink and/or damping solution metering units. The controller's memory stores various timing ramps with different slopes and durations. Each timing ramp stored in the memory corresponds to a different combination of the four parameters listed above. The appropriate timing ramp that corresponds to each combination of the four parameters is determined empirically. Once the controller has evaluated all four parameters, it selects the timing ramp stored in memory corresponding to that particular combination of parameters. The controller then increases or decreases the rotational speed of the motor (and thus the rotational speed of the printing cylinders) by directing the rectifier to supply an amount of current to the motor in direct proportion to the slope and duration of the timing ramp selected from memory.

By way of an example, if the rotational speed of the printing cylinders have to be increased or decreased while the printing cylinders are in the printing-on position, the controller will select a timing ramp with a relatively flat slope and long duration. In this manner, it is possible to increase or decrease the rotational speed of the printing cylinders over a long time period while eliminating or significantly minimizing torque disturbances on the printing cylinders and drive shafts. By eliminating or significantly minimizing torque disturbances on the printing cylinders and drive shafts, it is possible to eliminate or significantly reduce register offset or doubling phenomena on the printed matter.

Alternatively, if the rotational speed of the printing cylinders has to be increased or decreased while the printing cylinders are in the printing-off position, the controller will select a timing ramp with a relatively steep slope and short duration. In this manner, it is possible to increase or decrease the rotational speed of the printing cylinders over a short time period without regard to torque disturbances on the printing cylinders and drive shafts. Because no sheets are printed when the printing cylinders are in the printing-off position, the resultant torque disturbances on the printing cylinders and drive shafts do not cause any register offset or doubling phenomena. In particular, the sheet inlet may be released only when the machine has reached the prescribed final rotational speed and also the inking and damping solutions feeds are performing the appropriate metering function for the particular rotational speed.

By selecting the ramp for increasing or decreasing the rotational speed of the printing cylinders in part as a function of the line frequency, the rate and duration of change in the rotational speed of the printing cylinders can appropriately be adapted to the line-frequency-dependent rotational speed of the of the ink metering unit and damping solution metering unit drive motors. In this manner, the appropriate amount of ink and damping solution can be metered to the printing cylinders while their rotational speed is changing from the current speed to the desired speed. This particular aspect of the invention is particularly advantageous because the ink metering unit drive motor and/or damping solution metering unit drive motor are synchronous motors. These motors effect the metering of the ink and damping solution on to the printing cylinders. The rotational speed of these synchronous motors depends on the frequency of the line from which they operate, i.e., the line from which the printing machine operates. For example, if the printing machine is operated from a line with a frequency of 50 Hz, then the rotational speed of the inking unit drive motor and the damping unit drive motor is slower than if the printing machine is operated from a line with a frequency of 60 Hz.

BRIEF DESCRIPTION OF THE DRAWINGS

While the invention will be described in detail in connection with an illustrated embodiment, there is no intent to limit it to that embodiment. On the contrary, the intent is to cover all alternatives, modifications, and equivalents included within the spirit and scope of the invention as defined by the appended claims.

DETAILED DESCRIPTION OF THE PREFERRED EMBODIMENT

Figures 1, 1A:
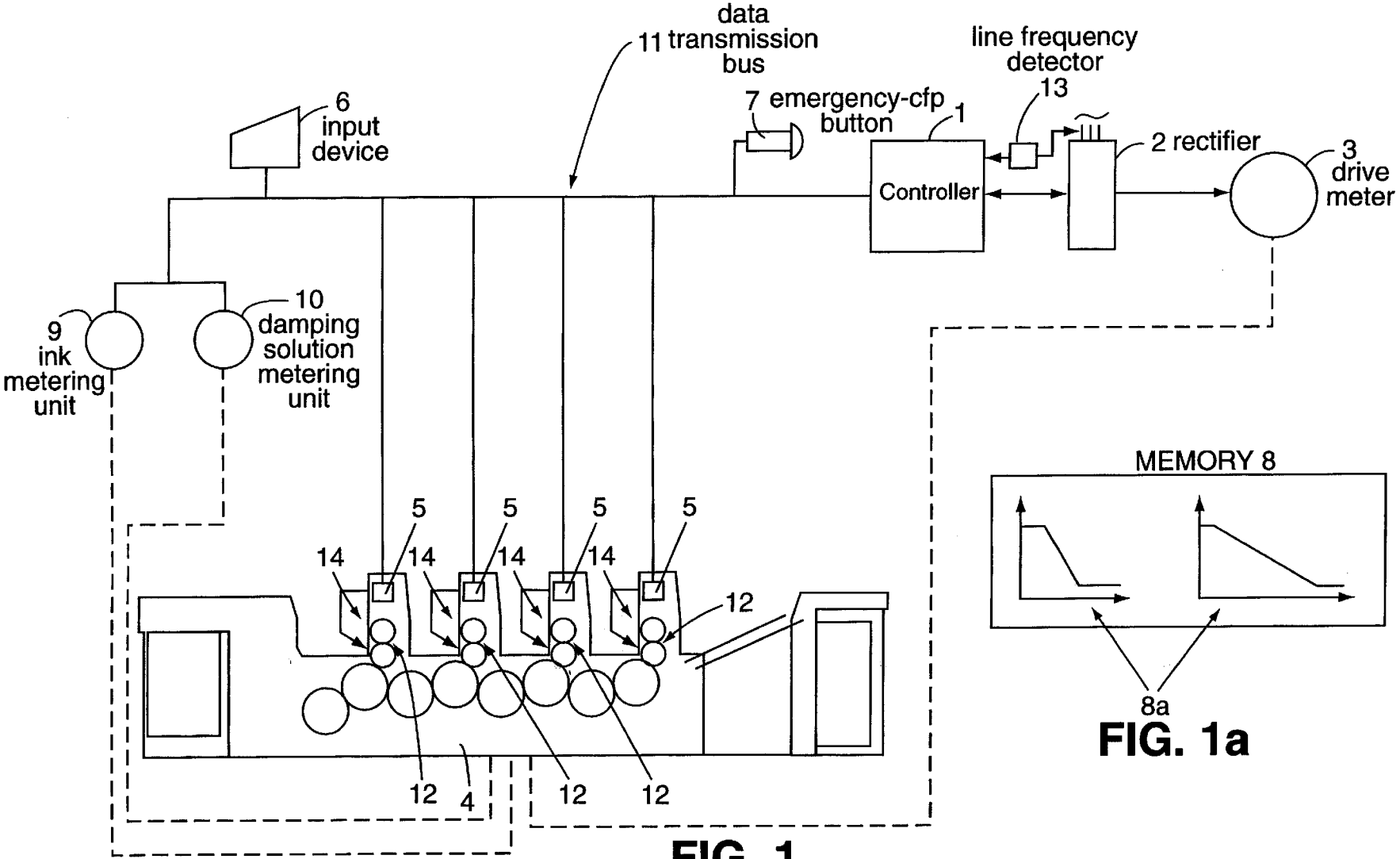
FIG. 1 is a diagrammatic representation of the control system according to the invention.
FIG. 1*a* is a diagrammatic representation of the various timing ramps stored on the memory 8 of the controller 1.

Referring to FIG. 1, the printing machine 4 has a controller 1 connected via a line-controlled rectifier 2 to a direct current drive motor 3. The controller 1 can be any conventional controller, for example, a microprocessor. The rectifier 2 and direct current motor 3 are also conventional and well known to those with ordinary skill in the art. The rectifier 2 rectifies the alternating line current into a direct current source which can be utilized by the direct current motor 3. The controller 1 controls and appropriately varies the current which is supplied by the rectifier 2 to the direct current motor 3. Of course, it is understood that the rotational speed of the direct current motor is directly proportional to the amount of current supplied by the rectifier 2 to the motor 3. Because the motor 3 is used to drive the printing cylinders 12 in the individual printing units 14 of the printing machine 4, the rotational speed of the printing cylinders is also directly proportional to the amount of current outputted by the rectifier 2. The direct current motor 3 is depicted diagrammatically in FIG. 1 apart from the printing machine 4. It is to be understood, however, that in the actual printing machine 4, the direct current motor 3 is located inside the printing machine 4 in such a manner as to drive the printing cylinders 12 in the printing units 14.

The controller 1 is connected by one or more data transmission lines, indicated here generally as bus system 11, to an input device 6, emergency-off push button 7, printing cylinder switch devices 5 in the individual printing units 14 of the printing machine 4, rectifier 2, motor 3 and line frequency detector 13. The input device 6 can be any conventional input device, for example, a keyboard. In the disclosed embodiment, the input device 6 comprises both the input device for the controller 1 and the operating buttons for the individual printing units, feeders, and deliveries of the printing machine 4. The printing cylinder switch devices 5 in the printing units 14 switch the printing cylinders 12 between the printing-on and printing-off positions, and also sense and send a signal to the controller 1 reflecting the current position of the printing cylinders 12. The printing cylinder switch devices 5 may be directed to actuate the printing cylinders between the printing-on and printing-off position through the input device 6 or, alternatively, by buttons or switches located on the printing units 14 of printing machine 4.

Figure 2A:
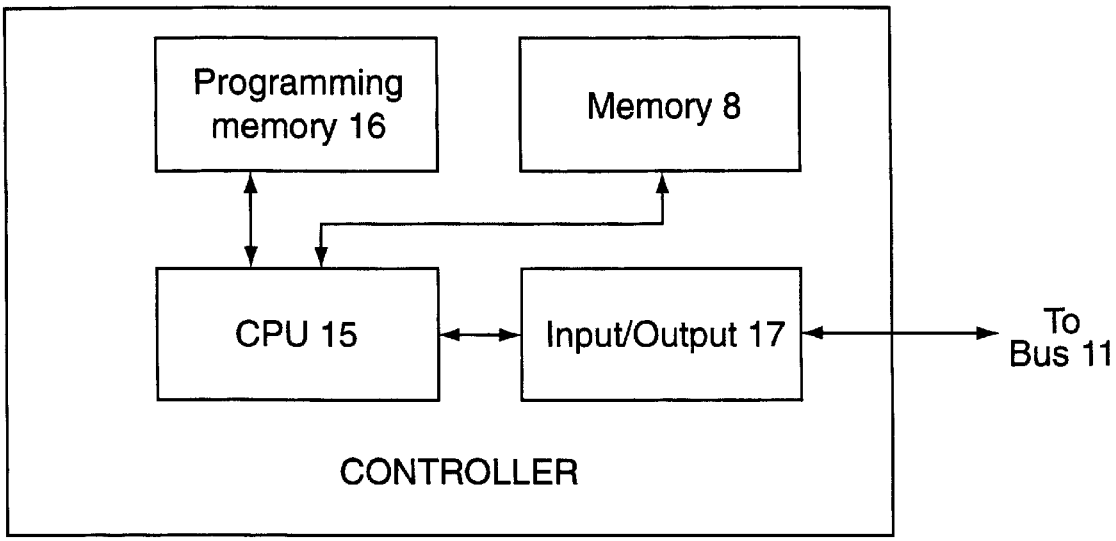
FIG. 2*a* is a diagrammatic representation of the controller 1.

Referring to FIG. 2*a*, the controller 1 is discussed in more detail. The controller 1 consists of a central processing unit (CPU) 15 which is connected to a programming memory 16, a memory 8, and an input/output device 17. The programming memory 16 stores the programming functions processed by the CPU 15. As shown in FIG. 1*a*, the memory 8 stores the timing ramps 8*a* used by the controller 1 to increase or decrease the rotational speed of the printing cylinders. Via the input/output device 17 and the data transmission bus 11 (shown in FIG. 1), the controller 1 can be in communication with the other components of the control system according to the invention, e.g., printing cylinder switch devices 5, input device 6, etc.

Figure 2B:
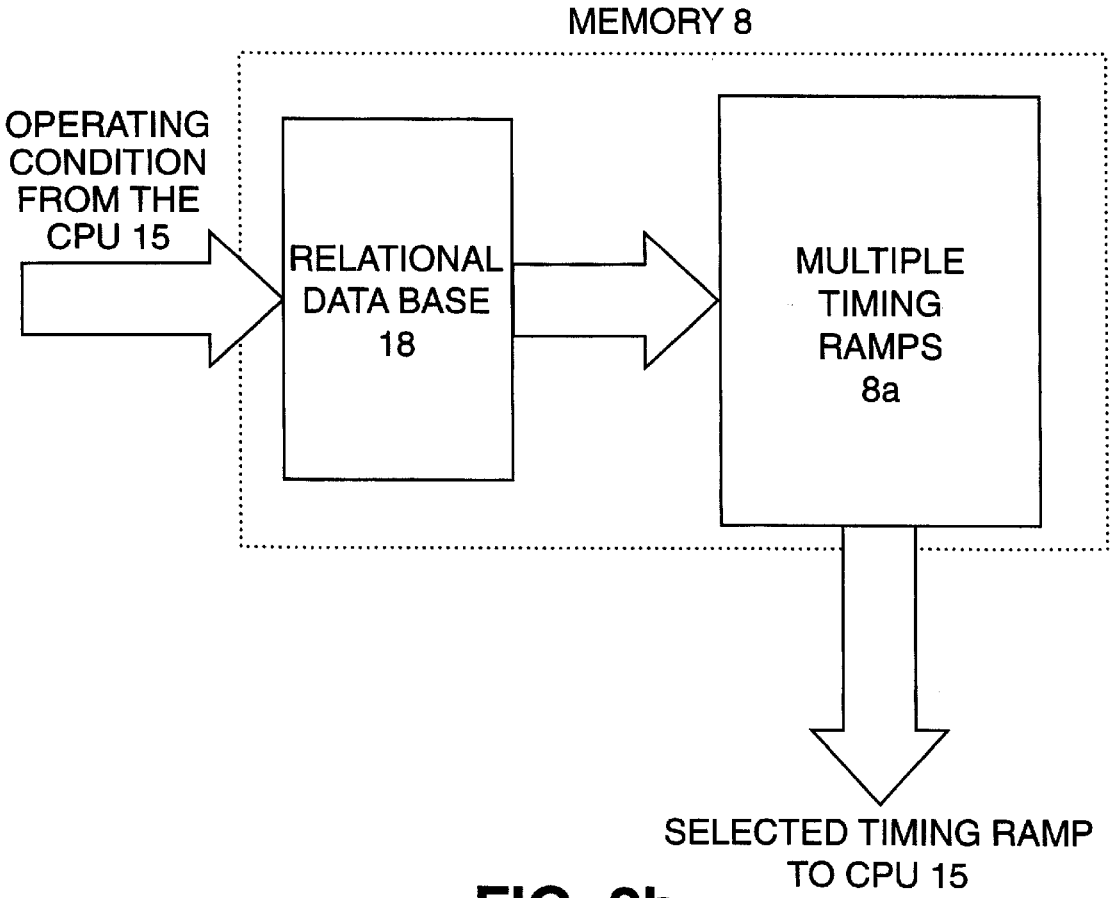
FIG. 2*b* is a diagrammatic representation of the memory 8.

Referring to FIG. 2*b*, the memory 8 of the controller 1 is discussed in detail. The memory 8 includes a relational data base 18 and the timing ramps 8*a* for increasing or decreasing the rotational speed of the printing cylinders. The slope and duration of the timing ramps 8*a* stored in the memory 8 vary as a function of four parameters : (1) whether the rotational speed of the printing cylinders is to be increased or decreased, (2) the net change in the rotational speed of the printing cylinders, i.e., the difference between the current rotational speed and desired rotational speed, (3) whether the printing cylinders are in the printing-on or printing-off position when the change in rotational speed is to occur, and (4) the frequency of the line from which the printing machine is operating. The appropriate timing ramp that corresponds to each combination of the four factors is determined empirically.

When the controller 1 receives a command to increase or decrease the rotational speed of the printing cylinders, the CPU 15 ascertains and communicates these four parameters to the relational data base 18 of the memory 8. Based on the four parameters communicated by the CPU 15, the relational data base 18 determines the location on the memory 8 of the most appropriate timing ramp 8*a* for increasing or decreasing the rotational speed of the printing cylinders. The selected timing ramp is then communicated to the CPU 15, and the controller 1 increases or decreases the current supplied to the drive motor 3 by the rectifier 2 in direct proportion to the slope and duration of the selected timing ramp in order to increase or decrease the rotational speed of the motor 3.

The controller 1 is also connected by the data transmission bus 11 to ink metering units 9 and damping solution metering units 10 in the printing units 14 of the printing machine 4. The ink metering unit 9 and damping solution metering unit 10 are depicted diagrammatically in FIG. 1 apart from the printing units 14. It is to be understood, however, that in the actual printing machine 4, the ink metering unit 9 and damping solution metering unit 10 are located inside the individual printing units 14 in such a manner as to meter the appropriate amount of ink and damping solution on to the printing cylinders 12. Ideally, the drive motors (not shown) of the ink metering units and damping solution metering units are synchronous motors. The rotational speed of these synchronous motors is directly proportional to the frequency of the line from which the printing machine operates. When the appropriate command to increase or decrease the rotational speed of the printing cylinders has been communicated to the controller 1 via the input device 6 and the controller has selected the appropriate timing ramp from the memory 8, the controller 1 also begins to increase or decrease the amount of ink metered by the metering unit 9 and the amount of damping solution metered by the metering unit 10 to the printing cylinders 12. In this manner, the appropriate amount of ink and damping solution is metered to the printing cylinders as the rotational speed of the printing cylinders is increased or decreased. As previously indicated, the slope and duration of the timing ramps stored in the memory 8 differ as a function of the frequency of the line from which the printing machine 4 is operated. In this manner, the rate and duration of change in the rotational speed of the printing cylinders 12 can appropriately be adapted to the line-frequency-dependent rotational speed of the inking unit and damping solution unit drive motors (not shown) of the printing units 14. The controller 1 can determine the line frequency through the line frequency detector 13. Alternatively, the line frequency can be inputted into the controller 1 during the controller's installation or by input device 6 during the printing machine's operation.

The controller 1 is also connected to an emergency-off button 7. Pressing the button 7 directs the controller to decrease the rotational speed of the printing cylinders in the quickest manner, irrespective of whether the printing cylinders are in the printing-on or printing-off position.

Figure 3A:
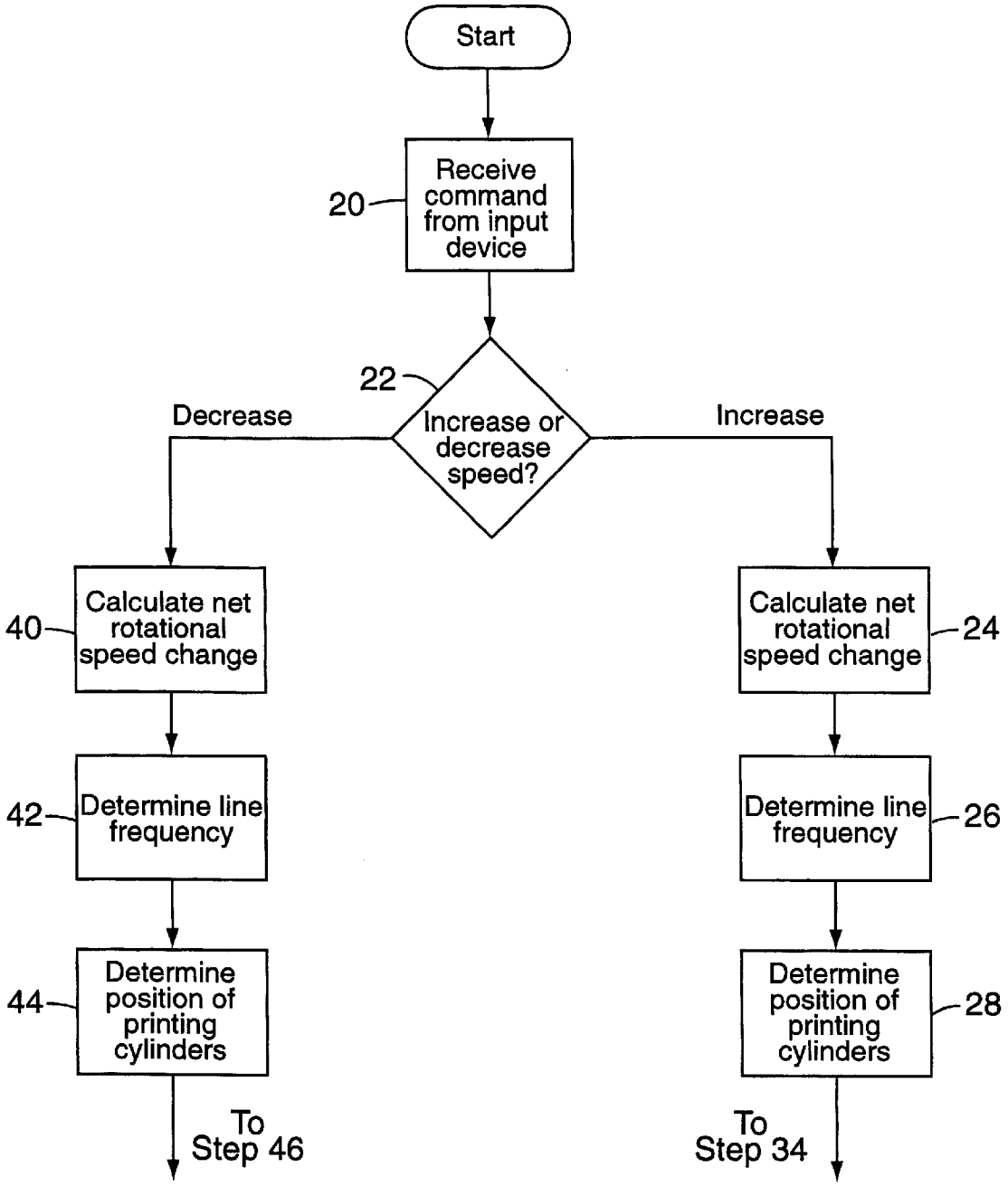
FIGS. 3*a* and 3*b* are a flow diagram of the steps executed by the controller to select the appropriate timing ramp from memory.
Figure 3B:
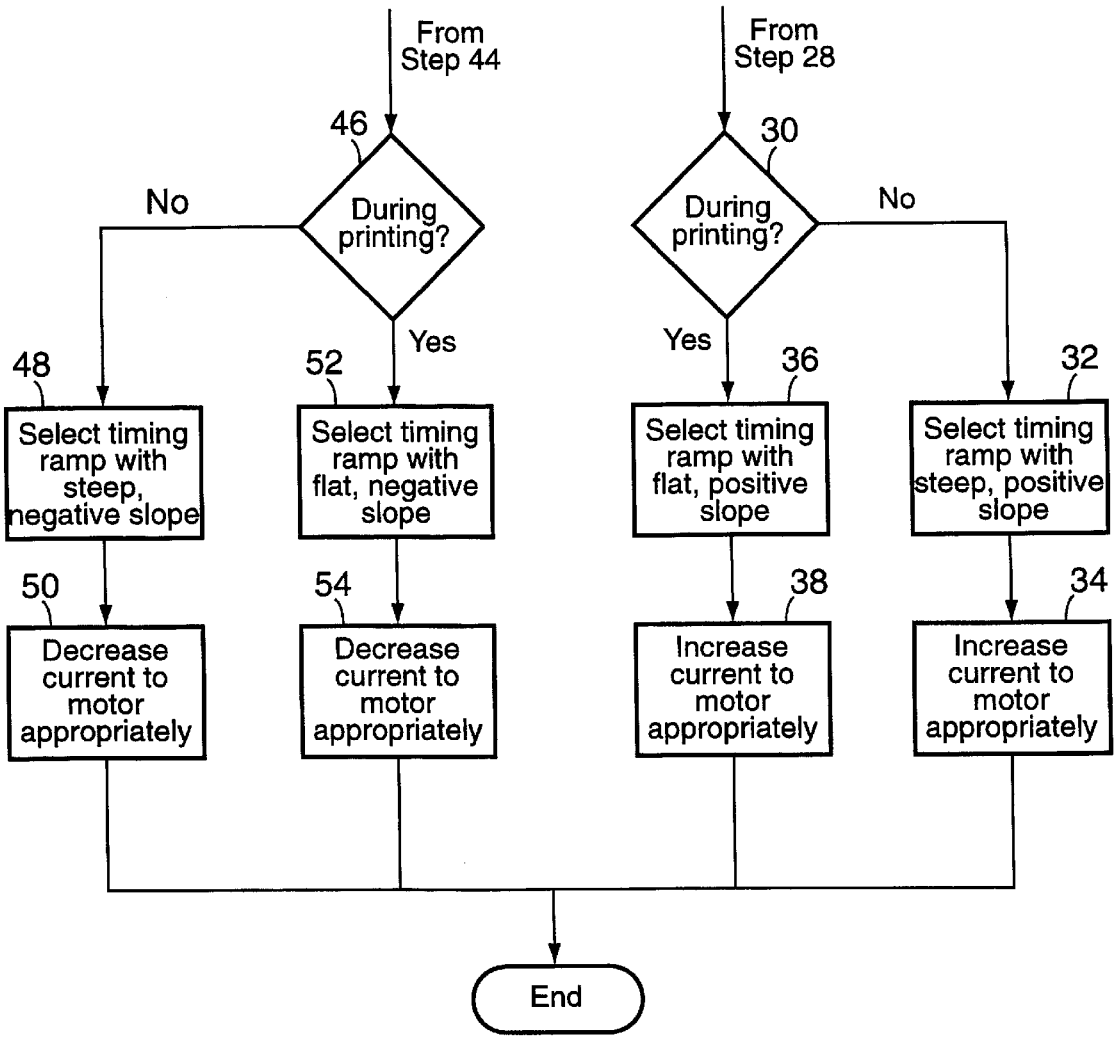

The operation of a printing machine according to the invention is now illustrated through an example, and with reference to FIGS. 1, 3*a* and 3*b*. At step 20, the controller 1 receives an input command via the input device 6 to change the rotational speed of the printing cylinders 12 form the current rotational speed to a desired rotational speed. At step 22, the controller 1 determines whether the input command of step 20 requires that the rotational speed of the printing cylinders 12 be increased or decreased. If the rotational speed of the printing cylinders 12 is to be increased, the controller 1 executes step 24 and its subsequent steps as shown in FIGS. 3*a* and 3*b*. If the rotational speed of the printing cylinders 12 is to be decreased, the controller 1 executes step 40 and its subsequent steps as shown in FIGS. 3*a* and 3*b*. It can be appreciated that the steps executed by the controller 1 after it determines whether the rotational speed of the printing cylinders are to be increased or decreased are substantially similar, the only difference being in the type of timing ramp that is selected from the memory 8 as a result of executing the steps. Thus, the steps executed by the controller 1 for increasing or decreasing the rotational speed of the printing cylinders will be discussed simultaneously.

At step 24 or 40, the controller 1 calculates the net rotational speed change, i.e., the difference between the current rotational speed and the desired rotational speed. At step 26 or 42, the controller 1 determines the frequency of the line from which the printing machine 4 is operating. The controller 1 can determine the line frequency by receiving a signal from the line frequency detector 13. Alternatively, the line frequency can be programmed into the controller at the time that the printing machine 4 is installed or it can be manually inputted by the input device 6 during the printing machine's operation. At step 28 or 44, the controller determines whether the printing cylinders are in the printing-on or printing-off position. The controller 1 determines the position of the printing cylinders 12 by receiving a signal from the printing cylinder switch devices 5 in the printing units 14 of the printing machine 4. Depending on the design of the printing machine 4, an operator may select the position of the printing cylinders by inputting commands through the input device 6, by using an input device or switch located on the printing unit 14 or printing machine 4, or by having a controller automatically control the switching of the printing cylinders. At step 30 or step 46, the controller uses the signal from the printing cylinder switch devices 5 to determine whether the increasing or decreasing of the rotational speed of the printing cylinders is to occur while the printing cylinders are in the printing-on or printing-off position.

If the rotational speed of the printing cylinders is to be increased while the printing cylinders 12 are in the printing-off position, then at step 32, the controller selects a timing ramp from the memory 8 that has a relatively short duration and steep, positive slope. At step 34, the controller increases the current supplied to the motor 3 by the rectifier 2 in direct proportion to the slope and duration of the timing ramp to increase the rotational speed of the motor 3. In this manner, the rotational speed of the printing cylinders 12 is increased in a relatively short time period. Because the printing cylinders are in the printing-off position, there is no need to be concerned about register offset or doubling phenomena on any printed matter. If the rotational speed of the printing cylinders is to be increased while the printing cylinders 12 are in the printing-on position, then at step 36 the controller selects a ramp from the memory 8 that has a relatively long duration and flat, positive slope. At step 38, the controller increases the current supplied to the motor 3 by the rectifier 2 in direct proportion to the slope and duration of the ramp to increase the rotational speed of the motor 3. In this manner the rotational speed of the printing cylinders 12 is increased in a relatively long time period. Thus, the additional moments acting on the printing cylinders and drive trains as a result of the acceleration in the printing cylinders' rotational speed are minimized and register offset or doubling phenomena are eliminated or significantly reduced.

If the rotational speed of the printing cylinders is to be decreased while the printing cylinders 12 are in the printing-off position, then at step 48, the controller selects a timing ramp from the memory 8 that has a relatively short duration and steep, negative slope. At step 50, the controller decreases the current supplied to the motor 3 by the rectifier 2 in direct proportion to the slope and duration of the timing ramp to decrease the rotational speed of the motor 3. In this manner, the rotational speed of the printing cylinders 12 is decreased in a relatively short time period. Because the printing cylinders are in the printing-off position, there is no need to be concerned about register offset or doubling phenomena on any printed matter. If the rotational speed of the printing cylinders is to be decreased while the printing cylinders 12 are in the printing-on position, then at step 52 the controller selects a timing ramp from the memory 8 that has a relatively long duration and flat, negative slope. At step 54, the controller decreases the current supplied to the motor 3 by the rectifier 2 in direct proportion to the slope and duration of the timing ramp to decrease the rotational speed of the motor 3. In this manner the rotational speed of the printing cylinders 12 is decreased in a relatively long time period. Thus, the additional moments acting on the printing cylinders and drive trains as a result of the deceleration in rotational speed are minimized and register offset or doubling phenomena are eliminated or significantly reduced.

As mentioned previously, the controller 1 is further connected via the data transmission bus 11 to the ink metering unit 9 and damping solution metering unit 10 in the individual printing units 14 of the printing machine 4. It can be appreciated, however, that the metering functions of the ink metering unit 9 and damping solution metering unit 10 can be controlled either by the controller 1 or by another separate controller. When the controller 1 receives the command to increase or decrease the rotational speed of the printing cylinders 12, it also begins to increase or decrease the amount of ink and damping solution metered by the ink metering unit 9 and damping solution metering unit 10 to an amount appropriate for the new rotational speed value of the printing cylinders. Especially when the increase or decrease in rotational speed is to occur while the printing cylinders are in the printing-on position, because of the line-frequency-dependent nature of the timing ramp chosen by the controller 1, the control system according to the invention has the ability to appropriately change the amount of ink and damping solution metered to the printing cylinders while the rotational speed of the printing cylinders is changing from the current speed to the desired speed. Thus, the slope and duration of the timing ramp selected by the controller 1 depends in part on the line-frequency-dependent rotational speed of the inking unit and damping unit synchronous drive motors. In this manner, register offsets or doubling phenomena as a result of over or under inking and/or damping is also avoided while the rotational speed of the printing cylinders is increasing or decreasing.

Figure 4:
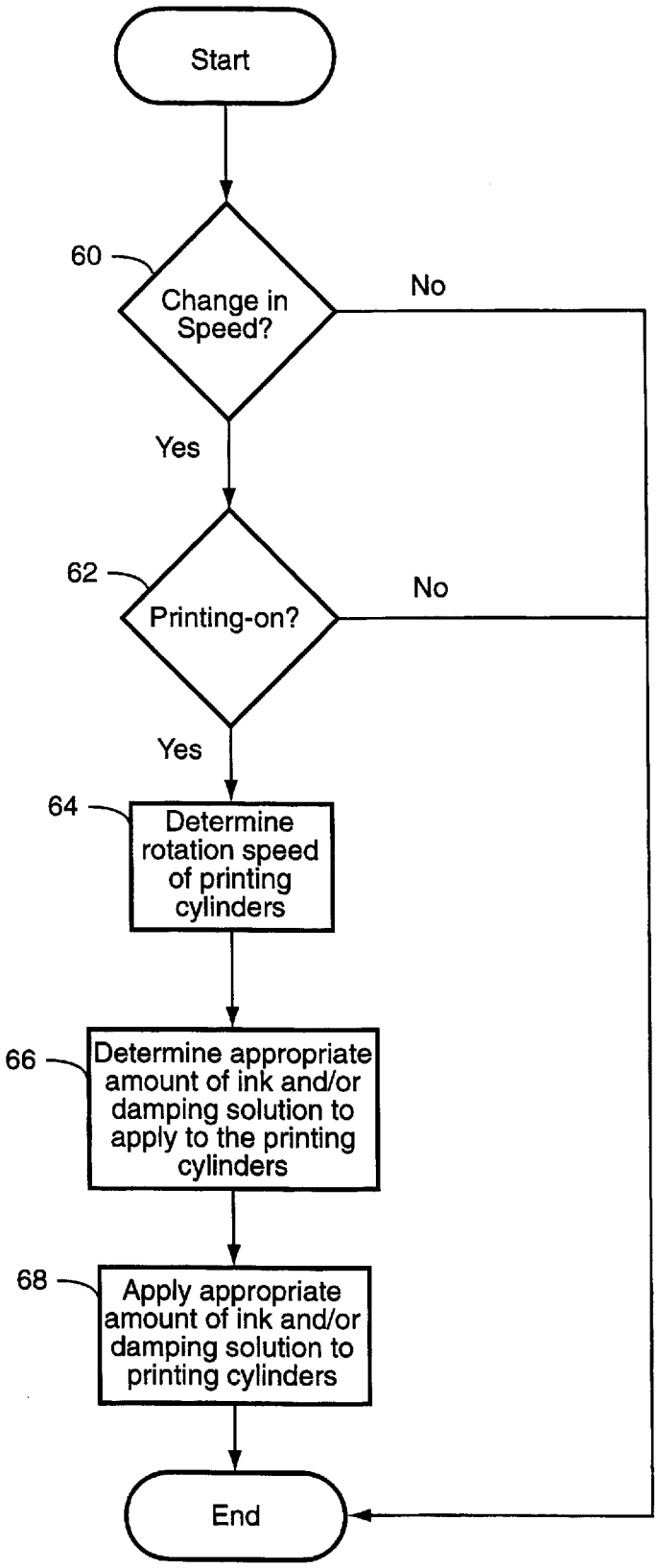
FIG. 4 is flow diagram of the steps executed by the controller to meter the appropriate amount of ink and/or damping solution on to the printing cylinders.

Referring to FIG. 4, the steps executed by the controller 1 (or alternatively, a separate controller responsible for metering ink and damping solution) are illustrated. At step 60, the controller 1 determines whether the rotational speed of the printing cylinders has changed. If the rotational speed of the printing cylinders has changed, at step 62 the controller determines whether the printing cylinders are in the printing-on or printing-off position. If the printing cylinders are in the printing-on position, at step 64 the controller determines the printing cylinders' rotational speed. At step 66, the controller 1 determines the appropriate amount of ink and/or damping solution that needs to be metered to the printing cylinders for that particular rotational speed. Then at step 68, the controller causes the appropriate amount of ink and/or damping solution to be applied to the printing cylinders.

What is claimed is:

1. In a sheet-fed offset printing machine having a printing unit driven by a DC drive motor powered from an AC line by way of an AC to DC rectifier, the printing unit having a printing cylinder, a printing cylinder switch device for switching the printing cylinder between printing-on and printing-off positions, an ink metering unit and a damping solution metering unit each driven by a synchronous drive motor by way of the AC line, a control system for the DC drive motor comprising: one or more sensors for resolving an operating condition of the printing unit and generating signals indicative thereof, where the operating condition includes a frequency of the AC line and the position of the printing cylinder; a controller receiving the signals; a memory in communication with the controller and having a data structure that includes multiple timing ramps having rate of change characteristics for controlling a change in the rotational speed of the printing cylinders and a relational data base for relating each of the timing ramps to different operating conditions of the printing unit; the controller including means responsive to a command to change the rotational speed of the printing cylinder for selecting one of the multiple timing ramps from the memory and controlling the DC motor by way of the rectifier in a manner that is proportional to the rate of change and duration characteristics of the selected timing ramp.

2. The control system of claim 1, wherein the controller receives the signal representing the position of the printing cylinder from the printing cylinder switch device.

3. The control system of claim 2, wherein the printing cylinder switch device is connected to the controller by a data transmission line.

4. The control system of claim 1, wherein the controller receives the signal representing the frequency of the AC line from a line frequency detector.

5. The control system according to claim 1, wherein when the controller receives the command to change the rotational speed of the printing machine, the controller adjusts the amount of ink metered by the ink metering unit to the amount appropriate for the changed rotational speed of the printing cylinder.

6. The control system according to claim 1, wherein when the controller receives the command to change the rotational speed of the printing machine, the controller adjusts the amount of damping solution metered by the damping solution metering unit to the amount appropriate for the changed rotational speed of the printing cylinder.

7. The control system according to claim 1, wherein the operating condition further includes whether the rotational speed of the printing cylinder is to be increased or decreased, and the net change in the rotational speed of the printing cylinder.

8. The control system of claim 1, further comprising an emergency-off button in communication with the controller.

9. The control system of claim 1, further comprising an input device in communication with the controller.

10. The control system of claim 9, wherein the input device is a keyboard.

11. The control system of claim 1, wherein the controller is a microprocessor.

* * * * *